US006761257B2

(12) United States Patent
Karlsson

(10) Patent No.: US 6,761,257 B2
(45) Date of Patent: Jul. 13, 2004

(54) COIN DISCRIMINATING DEVICE, COIN HANDLING APPARATUS INCLUDING SUCH A DEVICE, AND COIN DISCRIMINATING METHOD

(75) Inventor: Jerry Karlsson, Malmo (SE)

(73) Assignee: Scan Coin Industries AB, Malmo (SE)

( * ) Notice: Subject to any disclaimer, the term of this patent is extended or adjusted under 35 U.S.C. 154(b) by 0 days.

(21) Appl. No.: 09/924,521

(22) Filed: Aug. 9, 2001

(65) Prior Publication Data

US 2002/0074209 A1 Jun. 20, 2002

(51) Int. Cl.[7] ..... G07D 5/00

(52) U.S. Cl. ..... 194/330; 194/328; 73/163; 382/136; 396/332

(58) Field of Search ..... 453/3, 4; 194/328, 194/330; 73/163; 382/108, 136; 396/332

(56) References Cited

U.S. PATENT DOCUMENTS

| | | | | |
|---|---|---|---|---|
| 5,133,019 A | * | 7/1992 | Merton et al. | 382/136 |
| 5,230,653 A | | 7/1993 | Shinozaki et al. | |
| 5,743,373 A | | 4/1998 | Strauts | |
| 5,765,089 A | | 6/1998 | Hasuo et al. | |
| 6,417,471 B1 | * | 7/2002 | Rompel | 209/577 |

FOREIGN PATENT DOCUMENTS

| | | | | |
|---|---|---|---|---|
| DE | 3514779 | | 10/1986 | |
| EP | 0 601 302 A2 | | 9/1982 | |
| EP | 0675466 | | 10/1995 | |
| EP | 0683473 | | 11/1995 | |
| EP | 0784298 A1 | | 7/1997 | |
| GB | 2121582 A | * | 12/1983 | G07D/3/14 |
| JP | 6-274736 A | | 9/1994 | |
| JP | 10-11629 | | 1/1998 | |
| JP | 11-66377 | | 3/1999 | |
| WO | WO- 9715904 | | 5/1997 | |

* cited by examiner

*Primary Examiner*—Donald P. Walsh
*Assistant Examiner*—Mark J. Beauchaine

(57) ABSTRACT

A coin discriminating device has a first camera for producing a first image of a first surface of a coin, a second camera for producing a second image of a second surface of the coin, and a processor, e.g. a computer, which is operatively connected to the first and second cameras. The processor analyzes the first and second images in order to determine a type of the coin.

18 Claims, 4 Drawing Sheets

COIN DISCRIMINATING DEVICE, COIN HANDLING APPARATUS INCLUDING SUCH A DEVICE, AND COIN DISCRIMINATING METHOD

TECHNICAL FIELD

The present invention relates to coin discriminating devices, particularly of the kind comprising camera means for producing an image of a surface of a coin, and processing means, operatively connected to the camera means, for analyzing the image and determining a type of the coin. The present invention also relates to a coin handling apparatus incorporating such a coin discriminating device, and to a coin discriminating method.

BACKGROUND ART

Coin discriminating devices, or coin discriminators, are used in e.g. coin counting/sorting machines for identifying the type (e.g. denomination) of each coin that is processed by the machine. Furthermore, coin discriminators are used in coin inspection systems for sorting out foreign coins, counterfeit coins as well as coins that are unfit for further circulation (due to e.g. excessive wear).

Some coin discriminators operate inductively by exposing the coins to an alternating magnetic field by means of one or more than one coil and by detecting a physical property of the coin in response to the magnetic field exposure. For instance, the decay of eddy currents induced in the coin may be measured and used for determining the conductivity of the coin. Furthermore, magnetic properties such as permeability may be determined, as well as dimensional information, e.g. diameter or thickness.

Inductive coin discriminators are often able to successfully identify the metallic composition of the coin, thereby allowing a determination of the coin denomination by additionally using measurement data related to e.g. the coin diameter. However, not all coin types are distinctive enough, in terms of their magnetic and electric characteristics, to allow differentiation by means of an inductive coin discriminator.

A different and considerably more expensive kind of coin discriminators is optical pattern recognition discriminators, which produce e.g. a gray-scale or monochromatic image of the coin surface and identify the coin type by image analysis methods and comparisons with stored coin reference data. Optical pattern recognition discriminators of this type are shown in EP-A-0 798 669, EP-A-0 798 670, JP-A-10105765, JP-A-09259320 and U.S. Pat. No. 5,576,825. They comprise light emitting means for projecting light onto one surface of a coin, a camera or other optical sensor means for producing an image from the light reflected from the coin, and processing means for determining a type of the coin by comparing the image with reference data related to different types of coins.

A common drawback of these prior art discriminators is that only one surface of the coin is photographed and analyzed. Whether the determination is made for the front coin surface or for the rear coin surface will be completely random; it all depends on the orientation of the coin at the moment it passes the discriminator, i.e. whether the front surface or the rear surface faces the camera. Therefore, if the photographed surface has been severely altered due to e.g. excessive wear or other mechanical damage, the determination of type will be less accurate. Furthermore, since only one of the coin surfaces is used for the determination, the discriminator may experience severe difficulties in differentiating between two individual coins of different currency or denomination, if one surface of the first coin happens to resemble one surface of the second coin.

SUMMARY OF THE INVENTION

The object of the present invention is to provide an optical coin discriminating device, which more accurately may determine the type of individual coins.

This object is achieved by providing the discriminator with two separate cameras or optical sensors for producing one image of the first surface of each coin, and another image of the second coin surface. The processor of the discriminator is arranged to analyze both images and compare them to predetermined coin reference data in order to separately determine a type of the first surface and a type of the second surface. By combining the two determined surfaces, a type of the coin may be accurately established.

An important aspect of the present invention is the realization that such a coin discriminating device may advantageously be incorporated in an advanced coin handling apparatus recently developed by the applicant. In such a coin handling apparatus only an edge portion of each coin is engaged between two rotary transport means, thereby exposing a majority of both the front surface and the rear surface to the two cameras.

Other objects, features and advantages of the present invention appear from the following detailed disclosure, from the drawings as well as from the appended claims.

BRIEF DESCRIPTION OF THE DRAWING

The present invention will now be described in more detail, reference being made to the accompanying drawings, in which.

DETAILED DISCLOSURE OF THE INVENTION

Figure 1:
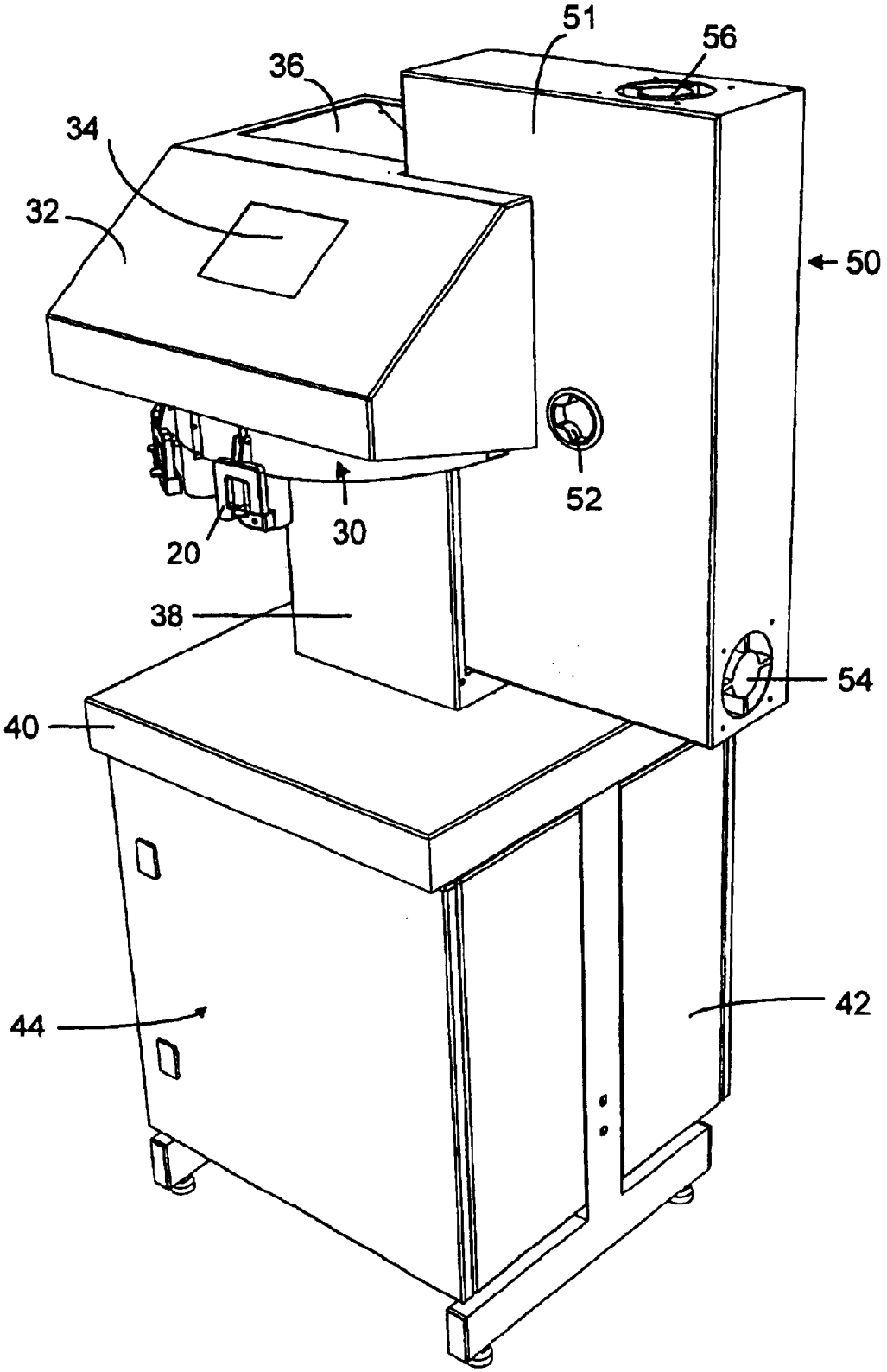
FIGS. 1 and 2 are schematic perspective views illustrating a coin handling apparatus incorporating a coin discriminating device according to a preferred embodiment.

FIG. 1 illustrates a coin handling apparatus having a separating device 30, which is mounted on a support frame 38 and a stand 40. A cabinet 42 having a door 44 is provided beneath the stand 40. A top cover 32 and additional side covers (not shown) protect and enclose the separating device 30 during operation. The cover 32 has a coin inlet 36 and an inspection window 34. An optical coin discriminator cabinet 50 is mounted next to the separating device 30. The discriminator cabinet 50 comprises a first and a second fan 54, 56 and a door 51, which may be unlocked by means of a lock handle 52 and swung open, as shown in FIG. 2.

Figure 2:
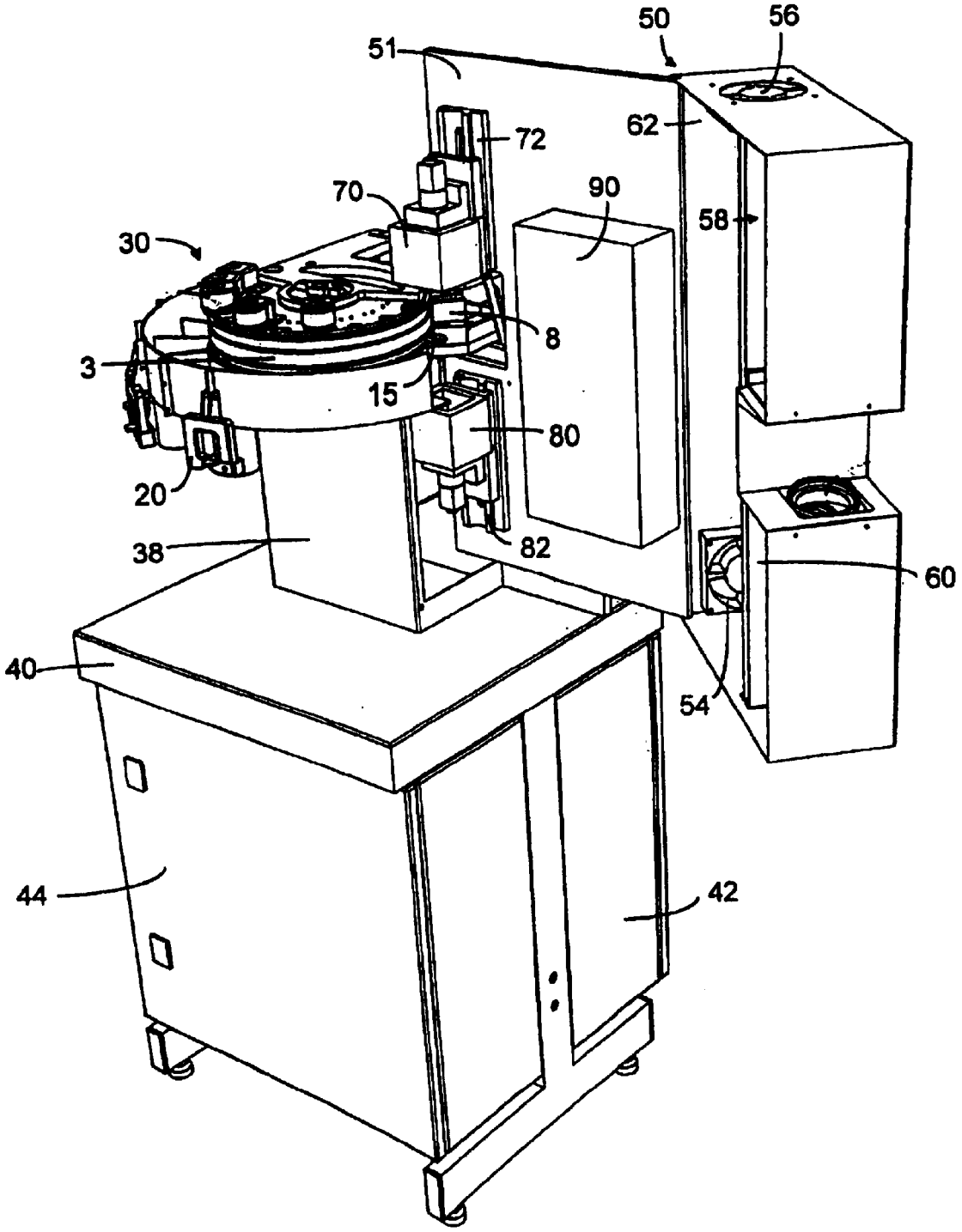

FIG. 2 illustrates the coin handling apparatus with the top cover removed and with the discriminator cabinet door 51 in an opened position. Three key elements of the inventive coin discriminating device are attached to the inner side of the door 51: a first camera 70, a second camera 80 and a processor 90. The cameras 70 and 80 are mounted on respective mounting rails 72 and 82. The cameras 70, 80 and the processor 90 all have a respective accomodation 58, 60 and 62 in the cabinet 50.

In the preferred embodiment, the cameras 70 and 80 are digital CCD cameras, which are arranged to produce digital grayscale images of both surfaces of a coin 15, as will be described in more detail below. However, the cameras may be replaced by any other optical sensors capable of producing monochromatic, grayscale or color images. Therefore, the term "camera means" used in the appended claims is to be interpreted in the broadest possible sense.

The processor 90 is implemented in the preferred embodiment by any commercially available computer, such as a PC-compatible computer, which is provided with an appropriate storage device (such as a hard disk), controller (such as a CPU), memory (such as RAM memory), operating system and image processing software. However, the processor may equally well be realized as another kind of hardware (such as ASIC circuits and/or discrete analog and digital components) and/or software, as is readily understood by a man skilled in the art. Consequently, the term "processing means" used in the appended claims is to be interpreted in the broadest possible sense.

The processor 90 is operatively connected to the cameras 70 and 80 and is arranged to receive the respective images once produced.

Figure 3:
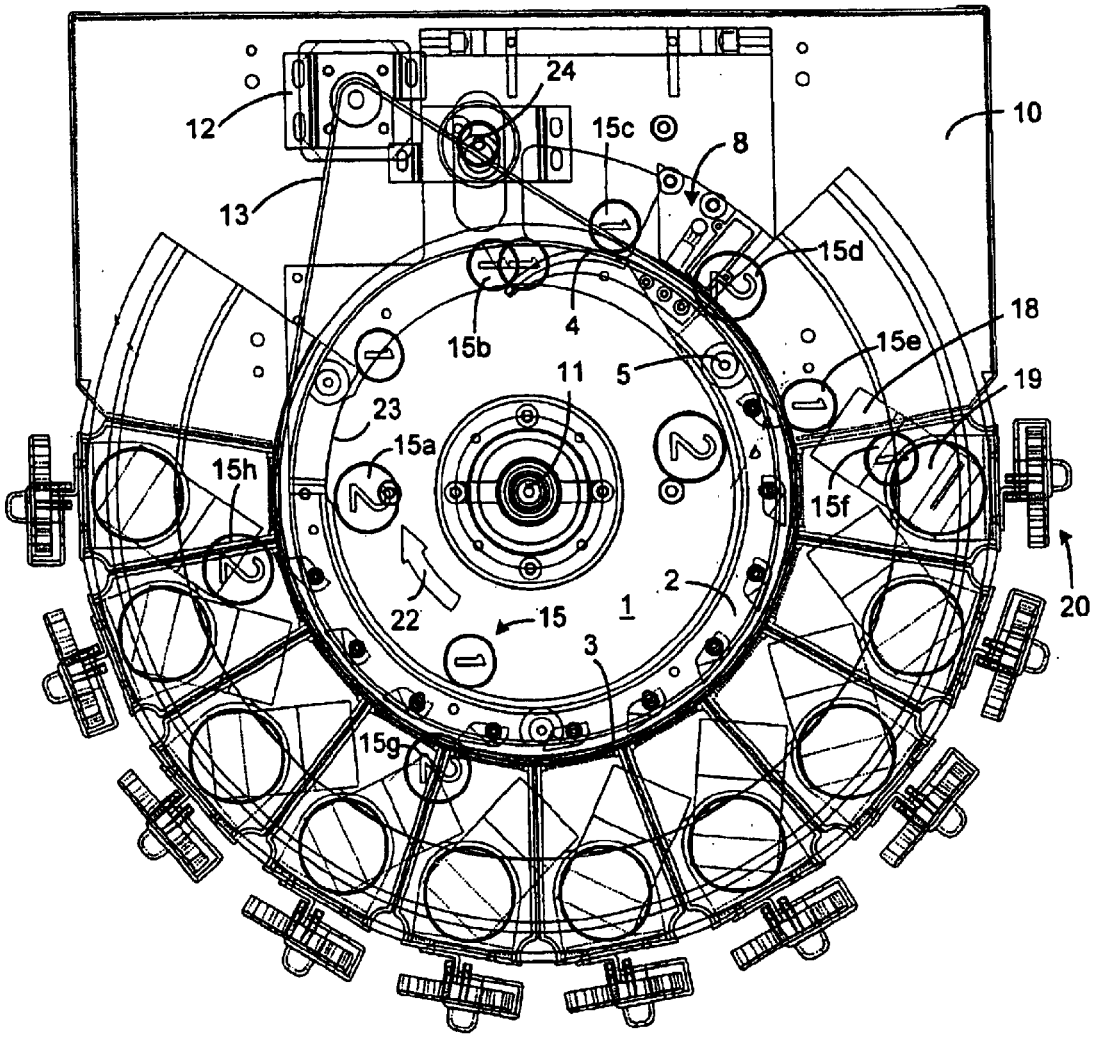
FIG. 3 is a plan view of a separating device in the coin handling apparatus of FIGS. 1 and 2.
Figure 4:
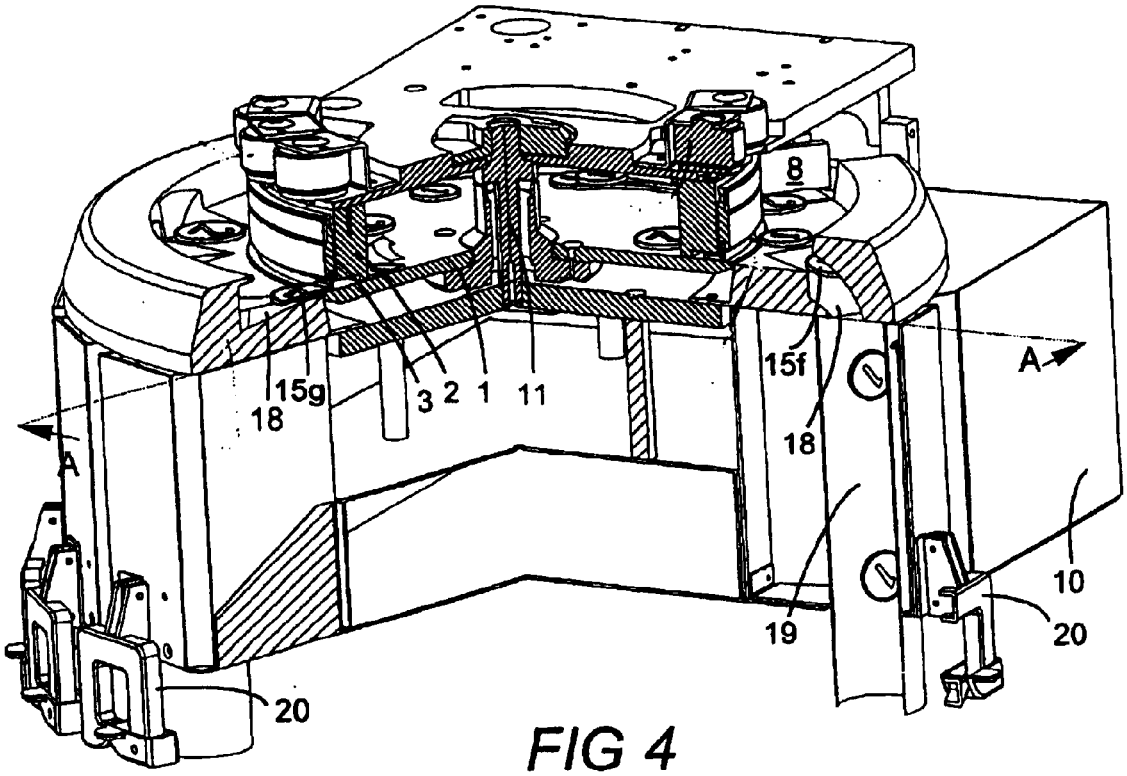
FIG. 4 is a perspective sectional view of the separating device.
Figure 5:
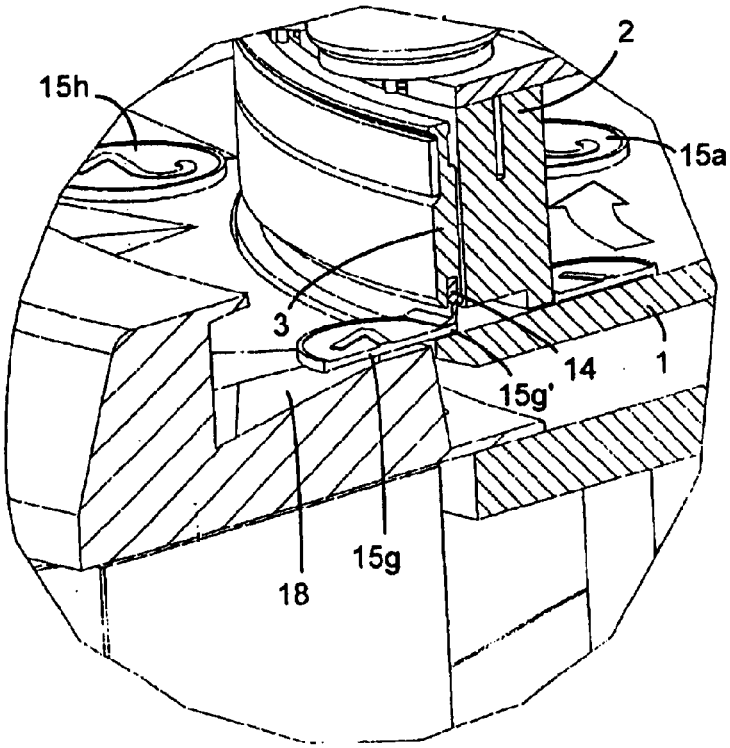
FIG. 5 is an enlarged view of a portion of FIG. 4.

The separating device 30 is illustrated in more detail in FIGS. 3–5 and is thoroughly described in PCT application No. PCT/SE98/02406 (not published yet), which is fully incorporated herein by reference. A summary of the separating device 30 follows below. Notice that no parts of the optical coin discriminating device 50 are shown in FIGS. 3–5.

The coin separating device 30 comprises an apparatus frame 10, a plurality of coin chutes 18, 19 and corresponding coin bag attachments 20 (only a few of which are shown in FIG. 2), which are all circularly arranged around the central components of the device, as described below. The bag attachments 20 may be provided with coin bags (not shown) for receiving and storing coins, that have been processed by the device. The lower ends of such coin bags may be supported by the top of the stand 40.

An essentially flat rotating disk 1 is mounted in its center point to an axle 11. A stationary ring 2 is arranged above the rotating disk 1 and is preferably made from steel, aluminum or plastics. The stationary ring 2 does not reach contact with the rotating disk 1 but is arranged immediately above the latter with only a minimum gap between them. On the outside of the stationary ring 2 a rotating ring 3 is mounted by means of three bearings 5, which are equiangularly located at the circumference of the rotating ring 3. On the underside thereof the rotating ring 3 is provided with an resilient strip or rim 14, as appears particularly from FIG. 5. The resilient rim 14 is advantageously made from an elastomer material. The rotating ring 3 is biased towards the rotating disk 1 by the mounting of bearings 5, so that the resilient rim 14 frictionally engages the upper surface of the rotating disk 1, thereby forcing the periphery of the rotating disk 1 to rotate at the same speed as the rotating ring 3, when the latter is driven by means of an electric motor 12 and a drive belt 13.

The rotating disk 1 is arranged to receive an unsorted plurality of coins 15 from e.g. a human user or a coin supply device not disclosed herein. For reasons of clarity, only a few coins 15, 15*a* . . . 15*h* have been indicated in the drawings. In reality, the number of coins may be considerably larger. As the disk 1 is rotated in a direction indicated by an arrow 22 in FIG. 3, the coins deposited onto the disk are accelerated by the centrifugal force in the radial direction of the disk towards the stationary ring 2, as indicated by 15*a* in FIG. 3. The plurality of coins are driven through an opening 23 in the stationary ring 2 and are forced into contact with the inside of the resilient rim 14 on the rotating ring 3 (see 15*b*). A thin stationary edge or knife 4 is mounted on the underside of the stationary ring 2 with a minimum gap to the upper surface of the rotating disk 1. As appears from FIG. 3, the stationary edge 4 has a curved shape, which starts tangentially from the outside wall of the stationary ring 2 and extends elliptically along a short, curved path towards the centerpoint of the disk 1. The stationary edge 4 ends at a point, which is located far enough from the periphery of the rotating ring 3 (i.e. the resilient rim 14) for allowing also coins of the largest possible diameter to be peeled off by this stationary edge 4, as described below.

The thickness of the stationary edge 4 is chosen so that only a single-layer file of coins will be deviated therefrom. As a plurality of coins 15*b* are centrifugally forced towards the rotating ring 3 and approach the stationary edge 4 by the rotation of the disk 1, the lowest layer of coins will be deviated or peeled off by the stationary edge 4 to form a single file of coins 15*c*, which are engaged between the resilient rim 14 and the rotating disk 1. In other words the stationary edge 4 pushes the lowest layer of coins in a single file through the resilient rim 14 to the outside wall of the stationary ring 2, which forms a reference edge. The coins 15 are engaged at the periphery thereof between the resilient rim 14 and the rotating disk 1 and are accurately transported, essentially without friction or other energy losses, along a circular sorting path. FIG. 5 provides a detailed illustration of a coin 15*g*, which is engaged at a short edge portion 15*g*' thereof between the rim 14 and the disk 1. As appears from FIG. 3, the coin 15*g* has been carried approximately 180° around its circular path starting from the point of engagement at 15*c*. Coins of small diameter (as seen at 15*c* and 15*e*) as well as coins of a larger diameter (as seen at 15*d* and 15*g*) may be freely engaged and transported between the resilient rim 14 and the rotating disk 1 in the manner described above.

Consequently, as shown in FIG. 2, both the front (upper) and the rear (lower) surfaces of a coin 15 will be essentially exposed to the first and second cameras 70, 80. When the coin 15 has been carried by the separating device 30 to the position shown in FIG. 2, the coin will be in vertical alignment with both cameras 70, 80. At this moment, the processor 90 will issue a control signal to the cameras 70, 80 to initiate the capturing of a first photographic image, by the first camera 70, of the front surface of coin 15, as well as a second photographic image, by the second camera 80, of the rear surface of said coin.

Depending on implementational conditions, the coin surfaces may have to be irradiated with external light, as is readily realized by the skilled person. Furthermore, measures may have to be taken for preventing optical interference between the two cameras 70, 80 due to such external light.

The first and second images thus produced will be transmitted to the processor 90 via suitable interface means (such as electrical wiring, electrical connectors at both ends, and electrical controllers). The processor will execute an image processing software routine to derive simplified and filtered digital images of the two coin surfaces. The end results thus obtained will be compared, by the processor 90, to predetermined coin reference data, which represent a plurality of known coin types and are stored in a storage device belonging to the processor 90. Preferably, the processor 90 calculates a maximum correlation between each of said first and second images and said predetermined reference data and determines a type of the coin 15 in response.

The coin type may relate to a denomination of the coin 15 or a currency of the coin 15. Alternatively, the determined type may be used by the processor 90 for differentiating authentic coins from counterfeit coins, or for identifying worn or damaged coins.

The coin separating device 30 may be provided with an additional coin discriminator 8, which is located prior to the optical discriminator 50 and is arranged to detect the passage of a respective coin 15*d* inductively, thereby identifying certain physical properties thereof, such as size, diameter, thickness, electric conductivity or magnetic permeability. As already mentioned, inductive coin discriminators are well-known per se. Among many other publications, a suitable coin discriminator is described in WO87/07742. The output of the inductive coin discriminator 8 will be supplied to the processor 90, which will use this information in addition to the images provided by the cameras 70, 80 when determining a type of the coin.

The coin separating device 30 may also be provided with an encoder 24 for determining the rotational speed of the rotating disk 1 and the rotating ring 3. The encoder 24 is operatively connected to the processor 90, which will use information received from the encoder and the inductive coin discriminator 8 to determine the correct position of coin 15 for capturing the images by the cameras 70, 80 (i.e., the position in which the coin 15 is vertically aligned with the cameras 70, 80).

The invention has been described above with reference to a preferred embodiment, the purpose of which is to exemplify the invention but in no way to limit the same. Therefore, the invention may be carried out in other ways than the one described above, and the scope of the invention is only limited by the appended independent patent claims.

What is claimed is:

1. A coin discriminating device, comprising:

camera means for producing a first image of a first surface of a coin and a second image of a second surface of the coin, the first and second surfaces being opposite each other;

processing means coupled to the camera means for analyzing the first and second images and determining a type of the coin; and first and second rotary members adapted to engage the coin at a peripheral portion thereof and transport the coin in a circular path past the camera means, the camera means being positioned so that the first and second surfaces of the coin are exposed to the camera means when the coin passes the camera means.

2. A coin discriminating device according to claim 1, wherein the camera means comprise a first camera positioned and adapted to produce the first image of the first surface of the coin, and a second camera positioned and adapted to produce the second image of the second surface of the coin.

3. A coin discriminating device according to claim 1, wherein the first and second surfaces of the coin are the front and rear surfaces of the coin.

4. A coin discriminating device according to claim 1, wherein the first and second images are produced essentially simultaneously by the camera means.

5. A coin discriminating device according to claim 1, wherein the first and second images produced by the camera means are digital color images.

6. A coin discriminating device according to claim 1, wherein the first and second images produced by the camera means are digital grayscale images.

7. A coin discriminating device according to claim 1, wherein the first and second images produced by the camera means are digital monochromatic images.

8. A coin discriminating device according to claim 1, wherein the first and/or second camera means comprise(s) a CCD camera.

9. A coin discriminating device according to claim 1, wherein the type determined by the processing means relates to a denomination of the coin.

10. A coin discriminating device according to claim 1, wherein the type determined by the processing means relates to a currency of the coin.

11. A coin discriminating device according to claim 1, wherein the type determined by the processing means is used for differentiating authentic coins from counterfeit coins.

12. A coin discriminating device according to claim 1, wherein the type determined by the processing means is used for identifying worn or damaged coins.

13. A coin discriminating device according to claim 1, further comprising:

a separating device for separating coins of different types into different locations.

14. A coin discriminating device according to claim 13, wherein the first and second rotary members are a functional part of the separating device.

15. A coin discriminating device according to claim 13, further comprising an inductive coin discriminator for determining a physical property of the coin.

16. A coin discriminating device according to claim 15, wherein said physical property is one of the following: size, diameter, thickness, electric conductivity or magnetic permeability.

17. A coin discriminating method, wherein first and second images, respectively, are produced of opposite surfaces of a coin and wherein the first and second images are analyzed with respect to predetermined reference data related to a plurality of coin types so as to determine a type of the coin, comprising the steps of:

providing first and second rotary members;

engaging the coin, at a peripheral portion thereof, between the first and second rotary means;

transporting the coin in a circular path to at least one predetermined position; and producing the first and second images at said at least one predetermined position.

18. A coin discriminating method according to claim 17, wherein the first and second images are produced essentially simultaneously at one predetermined position.

* * * * *